US012025148B2

(12) United States Patent
Ishii et al.

(10) Patent No.: US 12,025,148 B2
(45) Date of Patent: Jul. 2, 2024

(54) TURBOFAN

(71) Applicant: DENSO CORPORATION, Kariya (JP)

(72) Inventors: Fumiya Ishii, Kariya (JP); Syuzou Oda, Kariya (JP); Syoichi Imahigashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 18/152,861

(22) Filed: Jan. 11, 2023

(65) Prior Publication Data

US 2023/0141673 A1 May 11, 2023

Related U.S. Application Data

(63) Continuation of application No. PCT/JP2021/025145, filed on Jul. 2, 2021.

(30) Foreign Application Priority Data

Jul. 14, 2020 (JP) ..... 2020-120669

(51) Int. Cl.
*F04D 29/32* (2006.01)
*F04D 29/28* (2006.01)
*F04D 29/38* (2006.01)

(52) U.S. Cl.
CPC ..... *F04D 29/326* (2013.01); *F04D 29/281* (2013.01); *F04D 29/384* (2013.01)

(58) Field of Classification Search
CPC ..... F04D 29/32; F04D 29/326; F04D 29/28; F04D 29/281; F04D 29/38; F04D 29/384;
(Continued)

(56) References Cited

U.S. PATENT DOCUMENTS 4,647,271 A * 3/1987 Nagai ..... F04D 29/281 416/186 R
2010/0115983 A1 5/2010 Ikeda et al.
2014/0093366 A1 4/2014 Otsuka et al.

FOREIGN PATENT DOCUMENTS

CN 104471190 A * 3/2015 ..... F01D 5/14
JP H09-126190 A 5/1997
(Continued)

OTHER PUBLICATIONS

Bian, Tao et al. "Flow Guide and the Axial-flow Fan is Axial-flow Fan," Jan. 25, 2019, CPO (Year: 2019).*

*Primary Examiner* — Woody A Lee, Jr.
*Assistant Examiner* — Joshua R Beebe
(74) *Attorney, Agent, or Firm* — Harness, Dickey & Pierce, P.L.C.

(57) ABSTRACT

Each of a plurality of blades of a turbofan includes a thick wall portion, a thin wall portion and a stepped portion. The stepped portion is formed between the thick wall portion and the thin wall portion. A plate thickness of the stepped portion is progressively decreased toward a positive pressure surface of the blade in a direction that is directed from the thick wall portion toward the thin wall portion. In the blade, a first curved surface forms a negative pressure surface of the thick wall portion, and a second curved surface forms a negative pressure surface of the thin wall portion while the second curved surface is located on a side of the first curved surface where the positive pressure surface of the blade is placed, and a negative pressure surface of the stepped portion connects between the first curved surface and the second curved surface.

9 Claims, 6 Drawing Sheets

(58) Field of Classification Search
CPC ..... F04D 29/288; F04D 29/282; F05D 2240/301; F24F 1/0022; F01D 5/145
See application file for complete search history.

(56) References Cited

FOREIGN PATENT DOCUMENTS

| | | | | | |
|---|---|---|---|---|---|
| JP | 2006-009577 | A | | 1/2006 | |
| JP | 2016-160905 | A | | 9/2016 | |
| JP | 6071394 | B2 | | 2/2017 | |
| WO | WO-2008-111368 | A1 | | 9/2008 | |
| WO | WO-2010128618 | A1 | * | 11/2010 | ..... F04D 29/281 |

* cited by examiner

TURBOFAN

CROSS REFERENCE TO RELATED APPLICATIONS

This application is a continuation application of International Patent Application No. PCT/JP2021/025145 filed on Jul. 2, 2021, which designated the U.S. and claims the benefit of priority from Japanese Patent Application No. 2020-120669 filed on Jul. 14, 2020. The entire disclosures of all of the above applications are incorporated herein by reference.

TECHNICAL FIELD

The present disclosure relates to a turbofan.

BACKGROUND

A turbofan, which is used in a blower, is known. In general, the turbofan is characterized by low loss and high efficiency. However, the turbofan has the following disadvantage. That is, flow separation occurs at a negative pressure surface of a blade of the turbofan at a location which is slightly upstream from a trailing edge of the blade, and a vortex having a large velocity gradient is generated due to this flow separation such that the vortex interferes with the trailing edge of the blade, thereby resulting in generation of noise.

SUMMARY

This section provides a general summary of the disclosure, and is not a comprehensive disclosure of its full scope or all of its features.

According to the present disclosure, there is provided a turbofan that includes: a shroud which has a suction inlet that is configured to suction air; a main plate which is located on a side of the shroud in an axial direction of a rotational axis; and a plurality of blades which are located between the shroud and the main plate and are arranged one after another around the rotational axis. Each of the plurality of blades has a thick wall portion, a thin wall portion and a stepped portion. The thick wall portion is located adjacent to a leading edge of the blade. The thin wall portion has a plate thickness that is smaller than the plate thickness of the thick wall portion. The thin wall portion is located on a side of the thick wall portion where a trailing edge of the blade is placed. The stepped portion is formed between the thick wall portion and the thin wall portion. A plate thickness of the stepped portion is progressively decreased toward a positive pressure surface of the blade in a direction that is directed from the thick wall portion toward the thin wall portion.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
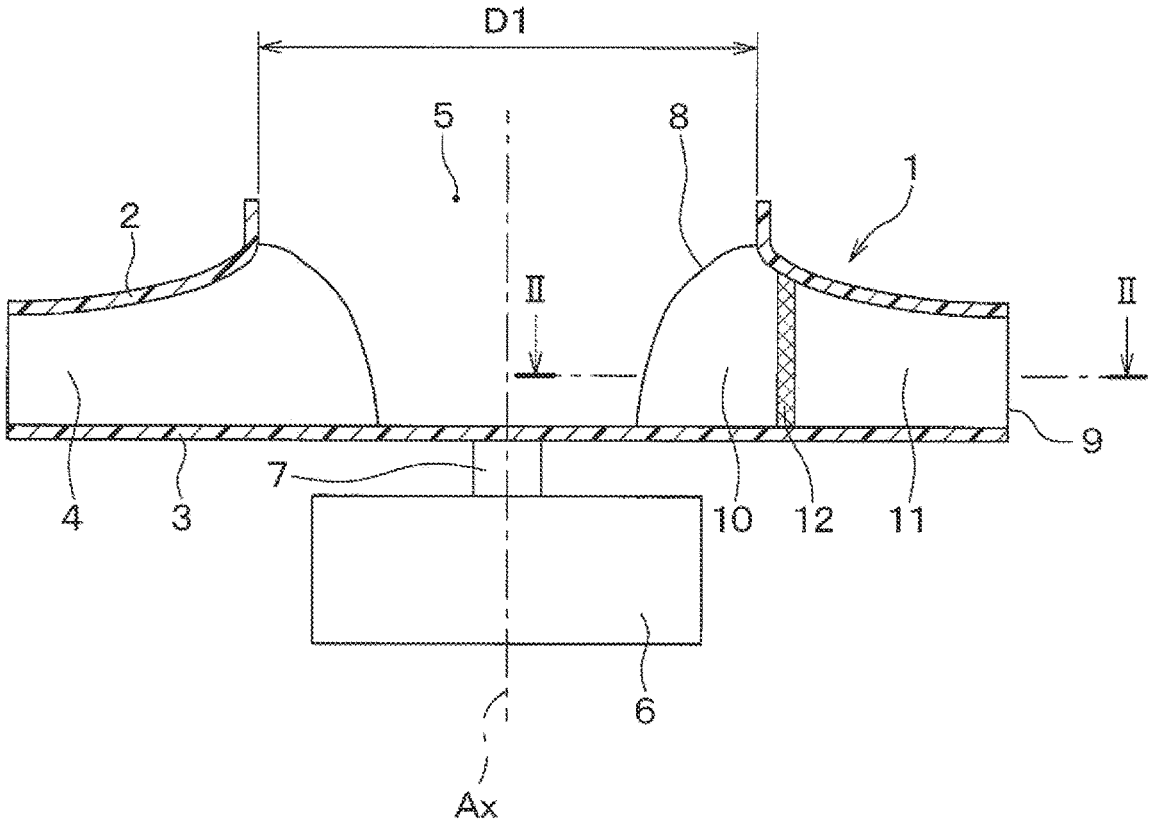
FIG. 1 is a cross-sectional view along a rotational axis of a turbofan according to a first embodiment.

A turbofan, which is used in a blower, is known. In general, the turbofan is characterized by low loss and high efficiency. However, the turbofan has the following disadvantage. That is, flow separation occurs at a negative pressure surface of a blade of the turbofan at a location which is slightly upstream from a trailing edge of the blade, and a vortex having a large velocity gradient is generated due to this flow separation such that the vortex interferes with the trailing edge of the blade, thereby resulting in generation of noise.

A previously proposed turbofan has a plurality of blades, each of which is shaped such that a plate thickness of the blade at a leading edge is thin, and the plate thickness is progressively increased from the leading edge toward a center portion of the blade and is then progressively decreased from the center portion toward a trailing edge of the blade. In the blade, two stepped portions are formed at a positive pressure surface and a negative pressure surface, respectively, at a location where the plate thickness is progressively increased from the leading edge toward the center portion. Therefore, in this blade, the plate thickness of a downstream portion, which is located on the downstream side of the stepped portions, is larger than the plate thickness of an upstream portion, which is located on the upstream side of the stepped portions. That is, the stepped portions can be said to be a plate thickness increasing portion, a plate thickness of which is progressively increased from the upstream side toward the downstream side.

According to the study of the inventors of the present application, with respect to the previously proposed turbofan, it is found that the flow, which is guided along the negative pressure surface of the blade, is separated at the stepped portion to generate a vortex having a large velocity gradient. Also, there is the following disadvantage. That is, the vortex interferes with the stepped portion (i.e., the plate thickness increasing portion) to generate noise.

Furthermore, the structure of the previously proposed turbofan does not solve a disadvantage that flow separation occurs at the negative pressure surface at the location that is slightly upstream side of the trailing edge of the blade, and a vortex having a large velocity gradient is generated due to this flow separation and interferes with the trailing edge of the blade to generate the noise.

According to one aspect of the present disclosure, there is provided a turbofan that includes: a shroud which has a suction inlet that is configured to suction air; a main plate which is located on a side of the shroud in an axial direction of a rotational axis; and a plurality of blades which are located between the shroud and the main plate and are arranged one after another around the rotational axis. Each of the plurality of blades has a thick wall portion, a thin wall portion and a stepped portion. The thick wall portion has a plate thickness that is relatively large, and the thick wall portion is located adjacent to a leading edge of the blade. The thin wall portion has a plate thickness that is smaller than the plate thickness of the thick wall portion, and the thin wall portion is located on a side of the thick wall portion where a trailing edge of the blade is placed. The stepped portion is formed between the thick wall portion and the thin wall portion, and a plate thickness of the stepped portion is progressively decreased toward a positive pressure surface of the blade in a direction that is directed from the thick wall portion toward the thin wall portion. In a cross-section of each of the plurality of blades that is perpendicular to the rotational axis, a first curved surface forms a negative pressure surface of the thick wall portion and is arcuate, and a second curved surface forms a negative pressure surface of the thin wall portion and is arcuate while the second curved surface is located on a side of the first curved surface where the positive pressure surface of the blade is placed, and a negative pressure surface of the stepped portion connects between the first curved surface and the second curved surface.

Therefore, a velocity boundary layer, which is generated in the flow along the negative pressure surface of the blade, begins to be disturbed at a boundary between the thick wall portion and the stepped portion, and this boundary functions as the separation point of the flow to generate a turbulent boundary layer therefrom. Thus, a main flow can be spaced away from the negative pressure surface of the thin wall portion in a direction that is opposite to a rotational direction. Therefore, in this turbofan, the position, at which the separation of the flow along the negative pressure surface of the blade occurs, is shifted forward in comparison to an ordinary turbofan that does not have the stepped portion. Thus, the velocity gradient of the flow, which collides against the negative pressure surface of the trailing edge of the blade, can be reduced to reduce the noise.

Furthermore, the stepped portion, which is formed in the middle of the blade, is shaped such that the plate thickness of the stepped portion is progressively reduced toward the positive pressure surface in the direction that is directed from the upstream side toward the downstream side in the flow direction of the air, so that it is possible to increase an interfering distance between the vortex, which has the large velocity gradient and is generated at the boundary (i.e., the separation point of the flow) between the thick wall portion and the stepped portion, and the negative pressure surface of the stepped portion. Thus, the noise, which is generated at the boundary (the separation point of the flow) between the thick wall portion and the stepped portion, can be reduced.

Hereinafter, embodiments of the present disclosure will be described with reference to the drawings. In each of the following embodiments, portions, which are the same or equivalent to each other, will be indicated by the same reference signs. In addition, with respect to the drawings referred to in each embodiment, a shape of each portion of a turbofan is described schematically for the sake of clarity, and this disclosure is not intended to be limited by it.

First Embodiment

A first embodiment of the present disclosure will be described with reference to the drawings. The turbofan of the present embodiment is used in a blower of, for example, an air conditioning apparatus or a ventilating apparatus.

Figure 2:
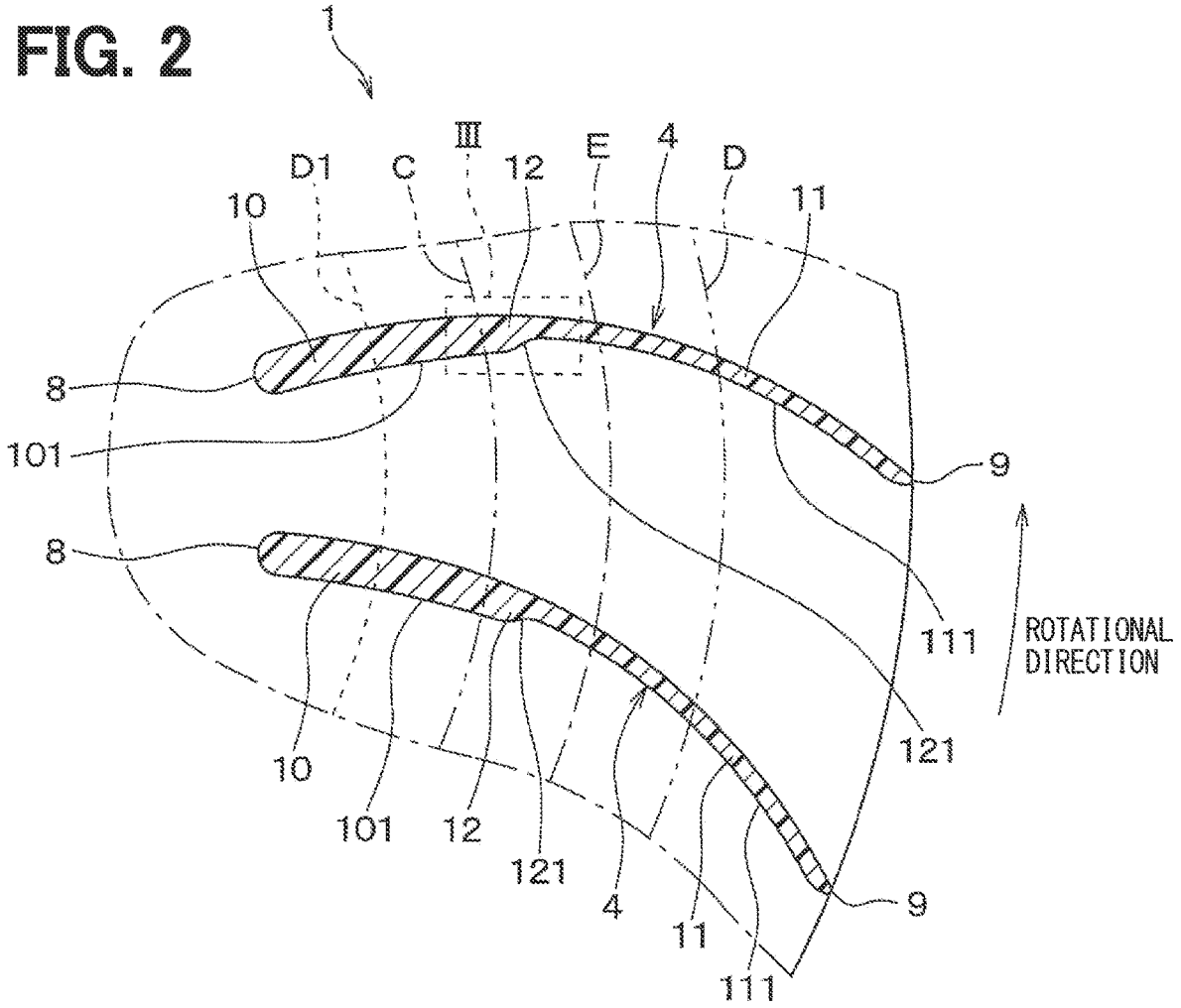
FIG. 2 is a cross-sectional view taken along line II-II in FIG. 1.

As shown in FIGS. 1 and 2, the turbofan 1 includes a shroud 2, a main plate 3 and a plurality of blades 4. The shroud 2 is shaped in a circular ring form and has a suction inlet 5. The suction inlet 5 is placed at a center of the shroud 2 and is configured to suction the air. The shroud 2 is shaped to progressively approach the main plate 3 in a direction that is directed from the suction inlet 5 toward the radially outer side, and the shroud 2 extends radially outward along the main plate 3. In FIG. 2, an inner diameter D1 of the suction inlet 5 of the shroud 2 (i.e., an inner diameter of the shroud 2) is indicated by a dotted line D1.

The main plate 3 is shaped in a circular disk form and is located on a side of the shroud 2 in an axial direction of the rotational axis. The main plate 3 is opposed to the shroud 2. The main plate 3 is generally perpendicular to the rotational axis AX of the turbofan 1. The shape of the main plate 3 is not limited to the planar shape shown in FIG. 1. For example, the main plate 3 may be shaped such that a center portion of the main plate 3 projects toward the suction inlet 5. The main plate 3 is fixed to a shaft 7 of an electric motor 6 and is rotated by the electric motor 6 about the rotational axis AX.

The blades 4 are located between the shroud 2 and the main plate 3 and are arranged one after another around the rotational axis Ax. The blades 4 are arranged at predetermined intervals in a rotational direction. Each of the blades 4 extends from a leading edge 8 toward a trailing edge 9 in a direction that is opposite to the rotational direction. The leading edge 8 of the blade 4 is located on a radially inner side of the inner diameter D1 of the suction inlet 5 of the shroud 2.

The turbofan 1 of the present embodiment is a closed fan, in which the main plate 3, the shroud 2 and the blades 4 are formed integrally in one-piece. Specifically, one of two opposite sides of the blade 4, which are directed opposite to each other in the axial direction of the rotational axis Ax, is joined to the main plate 3, and the other one of the two opposite sides of the blade 4 is joined to the shroud 2.

The turbofan 1 is rotated together with the shaft 7 by the electric motor 6. When the turbofan 1 is rotated, the air, which is suctioned from the suction inlet 5, flows from the leading edge 8 of the corresponding blade 4 through an inlet of a corresponding flow passage (hereinafter referred to as an inter-blade flow passage) formed between corresponding adjacent two of the blades 4 and is radially outwardly discharged from a corresponding air outlet of the inter-blade flow passage formed at the trailing edge 9 of the corresponding blade 4, the shroud 2 and the main plate 3.

Figure 3:
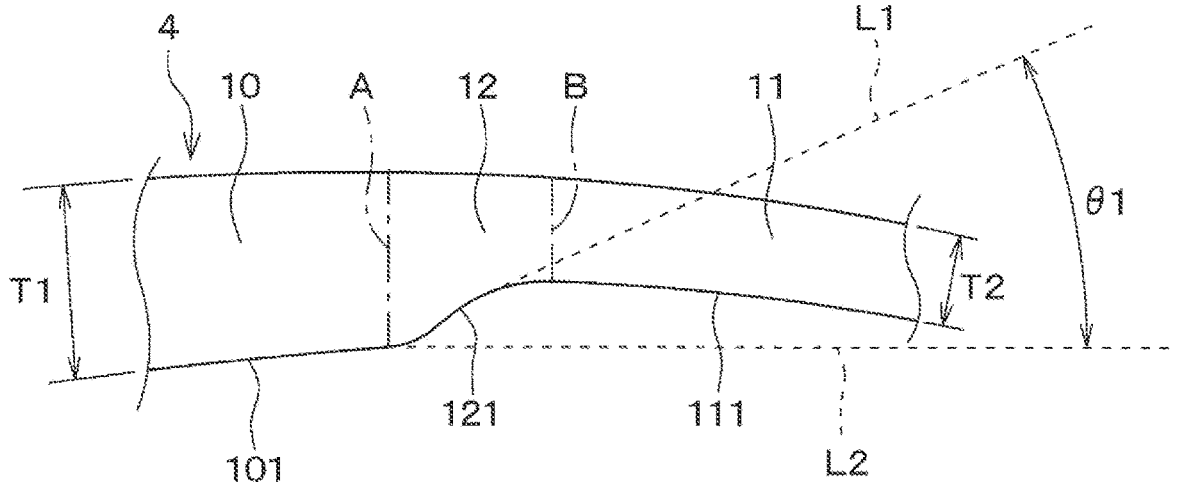
FIG. 3 is an enlarged view of a portion III in FIG. 2.

Next, the blades 4 of the turbofan 1 will be described with reference to FIGS. 1 to 3. In FIG. 3, hatching showing a cross section of the blade 4 is omitted for the purpose of easy visual recognition of the drawing.

As shown in FIGS. 1 to 3, each of the blades 4 includes a thick wall portion 10, a thin wall portion 11 and a stepped portion 12.

The thick wall portion 10 has a plate thickness that is relatively large, and the thick wall portion 10 is located adjacent to the leading edge 8 of the blade 4. In a cross-section of the blade 4 that is perpendicular to the rotational axis Ax, a negative pressure surface of the thick wall portion 10 is a curved surface that is arcuate and is convex toward a positive pressure surface of the blade 4. In the following description, the curved surface of the negative pressure surface of the thick wall portion 10 will be referred to as a first curved surface 101.

Preferably, the plate thickness T1 of the thick wall portion 10 is set to be equal to or larger than 3 mm. Furthermore, in the cross-section of the blade 4 that is perpendicular to the rotational axis Ax, preferably, a radius of curvature of a segment of the leading edge 8, which is adjacent to the positive pressure surface of the blade 4, and a radius of curvature of another segment of the leading edge 8, which is adjacent to the negative pressure surface of the thick wall portion 10, are respectively set to be equal to or larger than 1.5 mm.

The thin wall portion 11 has a plate thickness that is smaller than the plate thickness of the thick wall portion 10, and the thin wall portion 11 is located on a downstream side of the thick wall portion 10 (a side of the thick wall portion 10 where the trailing edge 9 is placed) at the blade 4. As shown in FIG. 2, in the cross-section of the blade 4 that is perpendicular to the rotational axis Ax, a negative pressure surface of the thin wall portion 11 is also a curved surface that is arcuate and is convex toward the positive pressure surface of the blade 4. In the following description, the curved surface of the negative pressure surface of the thin wall portion 11 will be referred to as a second curved surface 111. The second curved surface 111 of the thin wall portion 11 is located on the positive pressure surface side of the first curved surface 101 of the thick wall portion 10.

Preferably, the plate thickness T2 of the thin wall portion 11 is set to be, for example, equal to or smaller than 75% of the plate thickness T1 of the thick wall portion 10. The reason for this setting will be described later.

The stepped portion 12 is formed between the thick wall portion 10 and the thin wall portion 11, and a plate thickness of the stepped portion 12 is progressively decreased toward the positive pressure surface of the blade 4 in a direction that is directed from the thick wall portion 10 toward the thin wall portion 11. That is, the stepped portion 12 can be said to be a plate thickness decreasing portion, a plate thickness of which is progressively decreased from the upstream side toward the downstream side.

In FIG. 3, a boundary between the thick wall portion 10 and the stepped portion 12 is indicated by a dot-dash line A, and a boundary between the stepped portion 12 and the thin wall portion 11 is indicated by a dot-dash line B. However, it should be noted that these boundary lines are indicated for the purpose of the explanation, and in fact, the thick wall portion 10, the stepped portion 12 and the thin wall portion 11 are formed together in one-piece.

A negative pressure surface 121 of the stepped portion 12 is in a form of a smooth curved surface that connects between the first curved surface 101 of the thick wall portion 10 and the second curved surface 111 of the thin wall portion 11. That is, a negative pressure surface of the boundary between the stepped portion 12 and the thick wall portion 10 is shaped in a form of a smooth curved surface. Furthermore, a negative pressure surface of the boundary between the stepped portion 12 and the thin wall portion 11 is shaped in a form of a smooth curved surface. Furthermore, in the first embodiment, in the cross-section of the blade 4 that is perpendicular to the rotational axis Ax, the negative pressure surface 121 of the stepped portion 12 is shaped in a form of a curved surface that is convex toward the positive pressure surface of the blade 4.

As shown in FIG. 3, in the cross-section of the blade 4 that is perpendicular to the rotational axis Ax, a tangent line, which is tangent to a center part of the negative pressure surface 121 of the stepped portion 12, is defined as a first tangent line L1. Furthermore, a tangent line, which is tangent to an adjacent part of the negative pressure surface of the thick wall portion 10 that is adjacent to the stepped portion 12, is defined as a second tangent line L2. In the first embodiment, an angle 81 between the first tangent line L1 and the second tangent line L2 is an acute angle. Specifically, the angle 81 between the first tangent line L1 and the second tangent line L2 is, for example, in a range of 20° to 70°.

In FIG. 1, a location, at which the stepped portion 12 is formed at the negative pressure surface of the blade 4, is indicated by cross-hatching for the purpose of explanation. The stepped portion 12 is located on a radially outer side of the inner diameter D1 of the suction inlet 5 of the shroud 2.

Furthermore, in FIG. 2, two lines, which divide a blade length of the blade 4 into three equal parts, are indicated by dot-dot-dash lines C, D. The blade length refers to a length of the blade 4 along a camber line of the blade 4. The stepped portion 12 is located only at a center part that is centered among the three equal parts when the blade length is divided into the three equal parts. Furthermore, in the first embodiment, the stepped portion 12 is formed only in a region between the boundary line C, which is close to the leading edge 8 at the time of dividing the blade length into the three equal parts, and a boundary line E, which divides the blade length into two equal parts.

Figure 4:
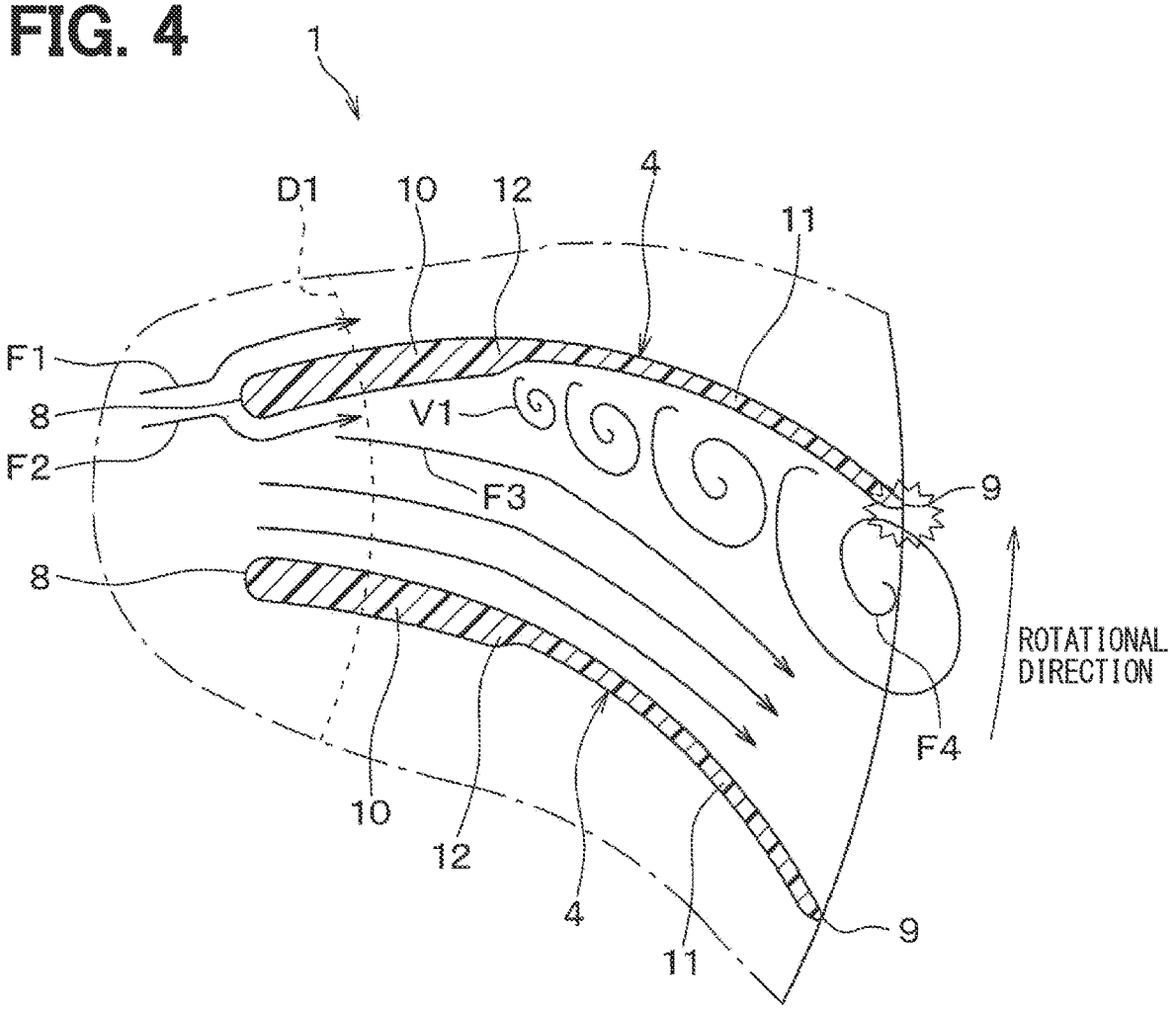
FIG. 4 is an explanatory diagram for explaining a flow of the air created by the turbofan according to the first embodiment.

Next, a flow of the air at the time of rotating the turbofan 1 of the present embodiment and actions and effects thereof will be described with reference to FIG. 4.

When the turbofan 1 is rotated, the air, which is suctioned from the suction inlet 5, flows from the leading edge 8 of each corresponding blade 4 into the corresponding inter-blade flow passage. At this time, as indicated by arrows F1, F2 in FIG. 4, the air, which flows adjacent to the leading edge 8 of the blade 4, flows in the corresponding inter-blade flow passage along the positive pressure surface or the negative pressure surface of the blade 4 due to the Coanda effect. As described above, in the present embodiment, the inter-blade flow passage is rapidly widened from the stepped portion 12 that is formed in the middle of the blade 4. Therefore, a velocity boundary layer, which is generated in the flow along the negative pressure surface of the blade 4, is disturbed, and this disturbance is started from the boundary between the thick wall portion 10 and the stepped portion 12. Then, a turbulent boundary layer is generated on the downstream side of this boundary that serve as a separation point of the flow. Therefore, a distance between the negative pressure surface (i.e., the second curved surface 111) of the thin wall portion 11 and the main flow F3 is progressively increased starting from the separation point toward the downstream side. Therefore, the flow velocity gradient of the flow F4, which collides against the negative pressure surface of the trailing edge 9 of the blade 4, is reduced, and thereby the noise is reduced.

Furthermore, in the present embodiment, the plate thickness of the stepped portion 12 is progressively reduced toward the positive pressure surface of the blade 4 in the direction that is directed from thick wall portion 10 toward the thin wall portion 11. Therefore, the vortex V1, which has the large velocity gradient and is generated at the boundary (i.e., the separation point of the flow) between the thick wall portion 10 and the stepped portion 12, flows in the inter-blade flow passage toward the downstream side with little interference with the negative pressure surface 121 of the stepped portion 12. Thus, the noise, which is generated at the boundary (i.e., the separation point of the flow) between the thick wall portion 10 and the stepped portion 12, becomes small.

Furthermore, in the present embodiment, in the negative pressure surface of the blade 4, the boundary between the stepped portion 12 and the thick wall portion 10 is in the form of the smooth curved surface, and the boundary between the stepped portion 12 and the thin wall portion 11 is also in the form of the smooth curved surface. The negative pressure surface 121 of the stepped portion 12 is shaped in the form of the curved surface that is convex toward the positive pressure surface of the blade 4. Therefore, even if there is the interference between the vortex V1, which is generated at the boundary (i.e., the separation point of the flow) between the thick wall portion 10 and the stepped portion 12, and the negative pressure surface of the stepped portion 12, the noise, which is generated at the negative pressure surface 121 of the stepped portion 12, becomes small.

Next, for the purpose of comparing with the turbofan 1 of the present embodiment, a flow of the air at the time of rotating a turbofan 100 of a comparative example will be described together with actions and effects of the turbofan 100.

Figure 5:
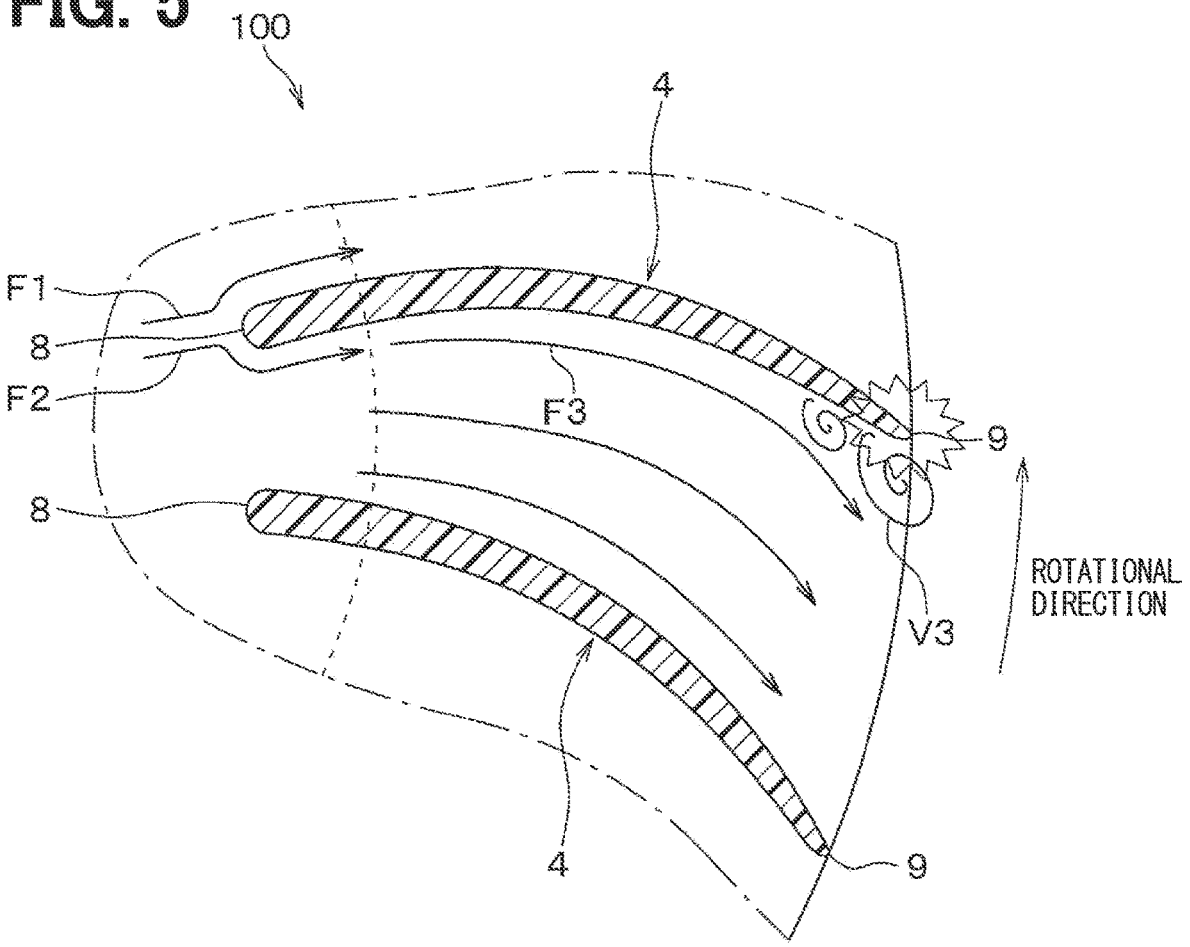
FIG. 5 is an explanatory diagram for explaining a flow of the air created by a turbofan of a comparative example.

As shown in FIG. 5, in the turbofan 100 of the comparative example, each blade 4 does not have the stepped portion 12, and the negative pressure surface of each blade 4 is formed by a single arcuately curved surface that extends from the leading edge 8 to the trailing edge 9.

Even in the comparative example, when the turbofan 100 is rotated, the air, which is suctioned from the suction inlet 5, flows from the leading edge 8 of each corresponding blade 4 to the corresponding inter-blade flow passage. At this time, as indicated by arrows F1, F2, the air, which flows adjacent to the leading edge 8 of the blade 4, flows in the corresponding inter-blade flow passage along the positive pressure surface or the negative pressure surface of the blade 4 due to the Coanda effect. Furthermore, in the comparative example, since the stepped portion 12 is not formed at each blade 4, as indicated by an arrow F3, the main flow in the inter-blade flow passage flows to the trailing edge 9 along the positive pressure surface or the negative pressure surface of the corresponding blade 4. Then, the flow is separated from the negative pressure surface of the blade 4 at a location, which is slightly spaced from the trailing edge 9 toward the upstream side, and thereby a vortex V3 having a large velocity gradient is generated due to the separation of the flow. Interference is generated between the vortex V3, which has the large velocity gradient, and the trailing edge 9 of the blade 4, and thereby noise is generated.

Figure 6:
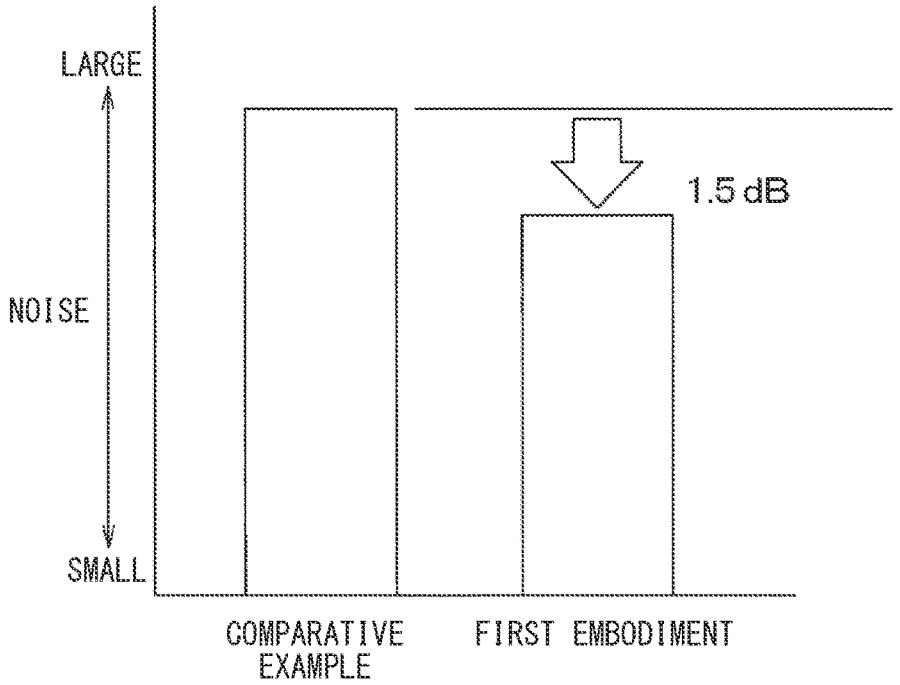
FIG. 6 is a graph comparing noise of the turbofan of the first embodiment and noise of the turbofan of the comparative example.

FIG. 6 shows an experimental result where the noise generated by the turbofan 1 of the first embodiment and the noise generated by the turbofan 100 of the comparative example are compared.

In the experiment, the turbofan 1 of the first embodiment and the turbofan 100 of the comparative example are rotated at the same rotational speed, and the noise of the turbofan 1 and the noise of the turbofan 100 are compared.

As shown in the graph of FIG. 6, according to this experiment, the turbofan 1 of the first embodiment can reduce the noise by 1.5 dB in comparison to the turbofan 100 of the comparative example.

Figure 7:
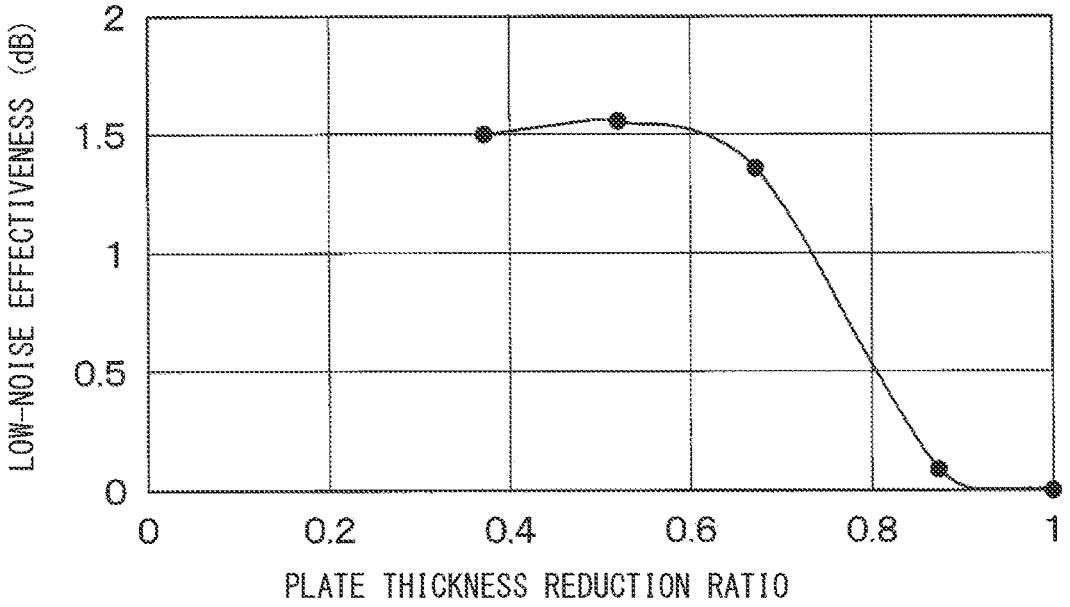
FIG. 7 is a graph showing a relationship between a plate thickness reduction ratio and a low-noise effect in the turbofan of the first embodiment.

FIG. 7 shows an experimental result indicating a relationship between a plate thickness reduction ratio of the blade 4 and a low-noise effect for the turbofan 1 of the first embodiment.

The plate thickness reduction ratio is a reduction ratio of the plate thickness T2 of the thin wall portion 11 relative to the plate thickness T1 of the thick wall portion 10.

In this experiment, a plurality of turbofans 1, which respectively have different plate thickness reduction ratios, are prepared, and the low-noise effect is measured at the time of rotating these turbofans 1 at a predetermined rotational speed. In this experiment, the rotational speed of the turbofans 1 are set at 3200 rpm, and the air flow rate is set at 535 $m^3$/min. In the graph shown in FIG. 7, the value 1 of the plate thickness reduction ratio corresponds to the plate thickness reduction ratio of the turbofan 100 of the comparative example that does not have the stepped portion 12 at each blade.

According to the graph of FIG. 7, it is understood that the low-noise effect becomes extremely large when the plate thickness reduction ratio is set to be equal to or smaller than 75%. Also, it is understood that the low-noise effect becomes equal to or larger than 1.5 dB when the plate thickness reduction ratio is set to be equal to or smaller than 60% (i.e., 0.6 in FIG. 7).

The turbofan 1 of the present embodiment described above implements the following actions and effects.

(1) In the present embodiment, the stepped portion 12, which rapidly expands the inter-blade flow passage between the adjacent blades 4, is formed between the thick wall portion 10 and the thin wall portion 11 of each blade 4. Therefore, the boundary between the thick wall portion 10 and the stepped portion 12 serves as the start point, at which the velocity boundary layer generated in the flow along the negative pressure surface of the thick wall portion 10 begins to be disturbed, and this boundary functions as the separation point of the flow from the negative pressure surface of the blade 4 to generate the turbulent boundary layer therefrom. Thus, the main flow F3 can be spaced away from the negative pressure surface of the thin wall portion 11 in a direction that is opposite to the rotational direction. Therefore, in this turbofan 1, the position, at which the separation of the flow along the negative pressure surface of the blade 4 occurs, is shifted forward in comparison to the turbofan 100 of the comparative example. Thus, the velocity gradient of the flow F4, which collides against the negative pressure surface of the trailing edge 9 of the blade 4, can be reduced to reduce the noise.

Furthermore, the stepped portion 12 is shaped such that the plate thickness of the stepped portion 12 is progressively reduced toward the positive pressure surface of the blade 4 in the direction that is directed from the upstream side toward the downstream side in the flow direction of the air, so that it is possible to increase an interfering distance between the vortex V1, which has the large velocity gradient and is generated at the boundary (i.e., the separation point of the flow) between the thick wall portion 10 and the stepped portion 12, and the negative pressure surface 121 of the stepped portion 12. Thus, the noise, which is generated at the boundary (the separation point of the flow) between the thick wall portion 10 and the stepped portion 12, can be reduced.

(2) In the present embodiment, the stepped portion 12 is located at the center part that is centered among the three equal parts when the blade length is divided into the three equal parts.

Here, a region (hereinafter referred to as a leading region), which is located in one of the three equal parts, which is placed closest to the leading edge 8 among the three equal parts at the time of dividing the blade length into the three equal parts, has a function of guiding the flow, which is supplied from the air inlet at the blade 4, along the wall surface of the blade 4 to improve the robustness with respect to an inflow angle of the flow. Therefore, it is not preferable to form the stepped portion 12 at the leading region.

Furthermore, when the stepped portion 12 is formed at a region (hereinafter referred to as a trailing region), which is located in another one of the three equal parts, which is placed closest to the trailing edge 9 among the three equal parts at the time of dividing the blade length into the three equal parts, a vortex having a large velocity gradient is initially separated from the blade 4 at the stepped portion 12 and collides against the negative pressure surface of the trailing edge 9 of the blade 4. Therefore, it is difficult to reduce the noise.

In the present embodiment, since the stepped portion 12 is not formed in the leading region, it is possible to improve the robustness to the inflow angle of the flow. Furthermore, the flow along the negative pressure surface of the thick wall portion 10 is disturbed at the stepped portion 12, which is formed at the center part, and this boundary functions as the separation point of the flow to generate a turbulent boundary layer therefrom. Thus, the main flow F3 can be spaced away from the negative pressure surface of the thin wall portion 11 in the direction that is opposite to the rotational direction. Thus, the turbofan 1 of the present embodiment can reduce the noise by reducing the velocity gradient of the flow F4, which collides against the negative pressure surface of the trailing edge 9 of the blade 4.

(3) In the present embodiment, the stepped portion 12 is located on the radially outer side of the inner diameter D1 of the suction inlet 5 of the shroud 2.

Here, if the stepped portion 12 is placed on the radially inner side of the inner diameter D1 of the suction inlet 5 of the shroud 2, it becomes difficult for the flow, which enters from the air inlet at the blade 4, to flow along the wall surface of the thick wall portion 10 from the leading edge 8 of the blade 4 in the inter-blade flow passage.

In contrast, in the present embodiment, since the stepped portion 12 is not placed on the radially inner side of the inner diameter D1 of the suction inlet 5 of the shroud 2, the flow, which enters from the air inlet at the blade 4, can flow along the wall surface of the thick wall portion 10 from the leading edge 8 of the blade 4 in the inter-blade flow passage. Therefore, it is possible to improve the robustness to the inflow angle of the flow.

(4) According to the present embodiment, the negative pressure surface of the boundary between the stepped portion 12 and the thick wall portion 10 is shaped in the form of the smooth curved surface.

Here, if a corner (e.g., a square corner) is formed along the negative pressure surface at the boundary between the stepped portion 12 and the thick wall portion 10, this corner may possibly interfere with the vortex V1, which has the large velocity gradient and is generated at the boundary (i.e., the separation point of the flow) between the thick wall portion 10 and the stepped portion 12, resulting in generation of the noise.

In contrast, according to the present embodiment, the corner is not formed along the negative pressure surface at the boundary between the stepped portion 12 and the thick wall portion 10. Therefore, even when the vortex V1 is generated at the boundary (i.e., the separation point of the flow) between the thick wall portion 10 and the stepped portion 12, the noise generated at this boundary can be reduced.

(5) In the present embodiment, preferably, the plate thickness T2 of the thin wall portion 11 is set to be equal to or smaller than 75% of the plate thickness T1 of the thick wall portion 10.

According to the above-described experimental result, by setting the plate thickness T2 of the thin wall portion 11 to be equal to or smaller than 75% of the plate thickness T1 of the thick wall portion 10, the low-noise effect can be significantly increased. According to the above-described experimental result, the noise can be reduced by 1.5 dB or more.

(6) In the present embodiment, in the cross-section of the blade 4 that is perpendicular to the rotational axis Ax, the negative pressure surface 121 of the stepped portion 12 is shaped in the form of the curved surface that is convex toward the positive pressure surface of the blade 4.

According to this structure, it is possible to increase the distance between the vortex, which is generated at the boundary (i.e., the separation point of the flow) between the thick wall portion 10 and the stepped portion 12, and the negative pressure surface 121 of the stepped portion 12, and thereby the noise generated at this boundary can be reduced.

(7) According to the present embodiment, in the cross-section of the blade 4 that is perpendicular to the rotational axis Ax, the angle 81 between the first tangent line L1, which is tangent to the center part of the negative pressure surface 121 of the stepped portion 12, and the second tangent line L2, which is tangent to the adjacent part of the negative pressure surface of the thick wall portion 10 that is adjacent to the stepped portion 12, is the acute angle.

With this structure, the corner is not formed along the negative pressure surface at the boundary between the stepped portion 12 and the thick wall portion 10. Therefore, even when the vortex is generated at the boundary (i.e., the separation point of the flow) between the thick wall portion 10 and the stepped portion 12, the noise generated at this boundary can be reduced.

(8) According to the present embodiment, in the cross-section of the blade 4 that is perpendicular to the rotational axis Ax, preferably, the radius of curvature of the segment of the leading edge 8, which is adjacent to the positive pressure surface of the blade 4, and the radius of curvature of the other segment of the leading edge 8, which is adjacent to the negative pressure surface of the thick wall portion 10, are respectively set to be equal to or larger than 1.5 mm. Preferably, the plate thickness T1 of the leading edge 8 of the blade 4 is set to be equal to or larger than 3 mm.

With this structure, by increasing the plate thickness T1 of the leading edge 8, the flow, which enters from the air inlet at the blade 4, can flow along the wall surface of the thick wall portion 10 from the leading edge 8 of the blade 4 in the inter-blade flow passage. Therefore, it is possible to improve the robustness to the inflow angle of the flow.

Second Embodiment

The second embodiment will be described with reference to FIG. 8. The second embodiment is a modification of the structure of the stepped portion 12 of the blade 4 in comparison to the first embodiment, and the rest of the second embodiment is the same as that of the first embodiment. Therefore, only the parts different from those of the first embodiment will be described in the following description.

Figure 8:
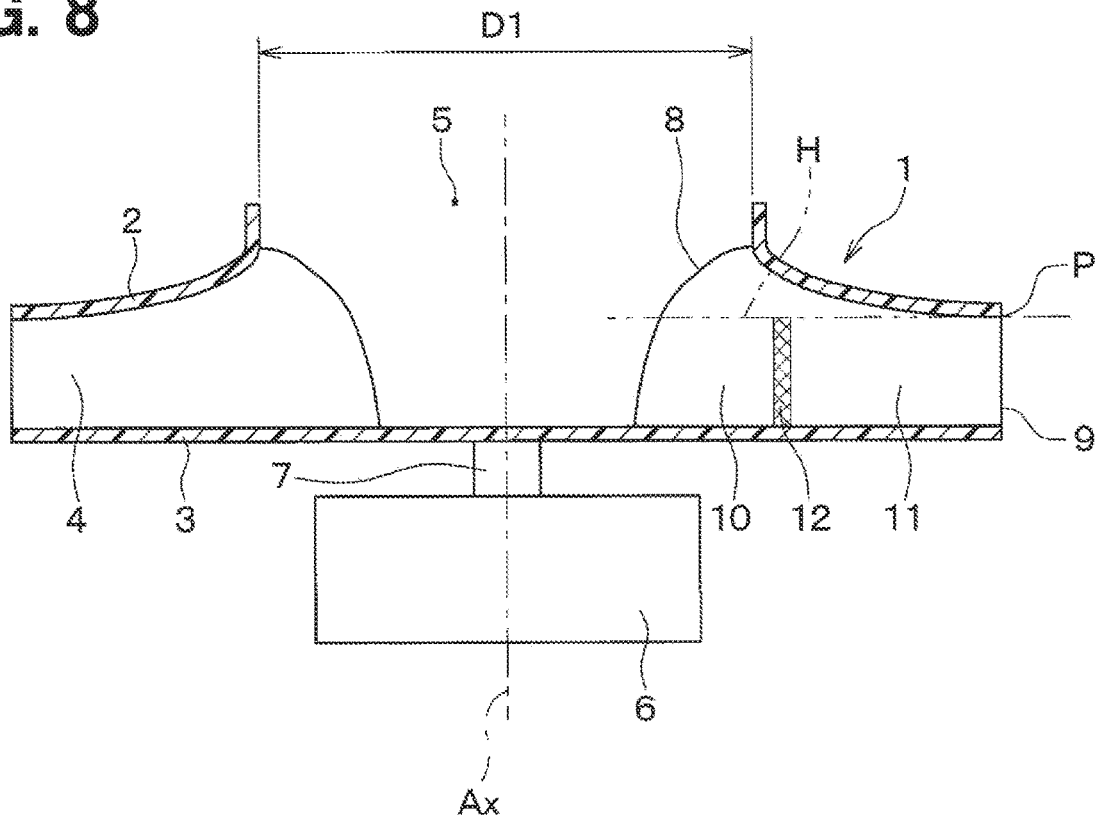
FIG. 8 is a cross-sectional view along a rotational axis of a turbofan according to a second embodiment.

Even in FIG. 8, a location, at which the stepped portion 12 is formed at the negative pressure surface of the blade 4, is indicated by the cross-hatching for the purpose of explanation. An imaginary line H, which includes a connecting point P between the trailing edge 9 of the blade 4 and the shroud 2 and is perpendicular to the rotational axis Ax, is indicated by a dot-dot-dash line.

As shown in FIG. 8, in the second embodiment, the stepped portion 12 is formed in a height range of the trailing edge 9 of the blade 4. Specifically, the stepped portion 12 is formed between the above-described imaginary line H and the main plate 3. With this structure, the main flow can be spaced away from the negative pressure surface of the trailing edge 9 of the blade 4 in the direction that is opposite to the rotational direction in the height range of the trailing edge 9 of the blade 4. Therefore, the noise, which is generated at the trailing edge 9 of the blade 4, can be reduced.

Third Embodiment

The third embodiment will be described with reference to FIG. 9. The third embodiment is a modification of the structure of the stepped portion 12 of the blade 4 in comparison to the first embodiment, and the rest of the third embodiment is the same as that of the first embodiment. Therefore, only the parts different from those of the first embodiment will be described in the following description.

Figure 9:
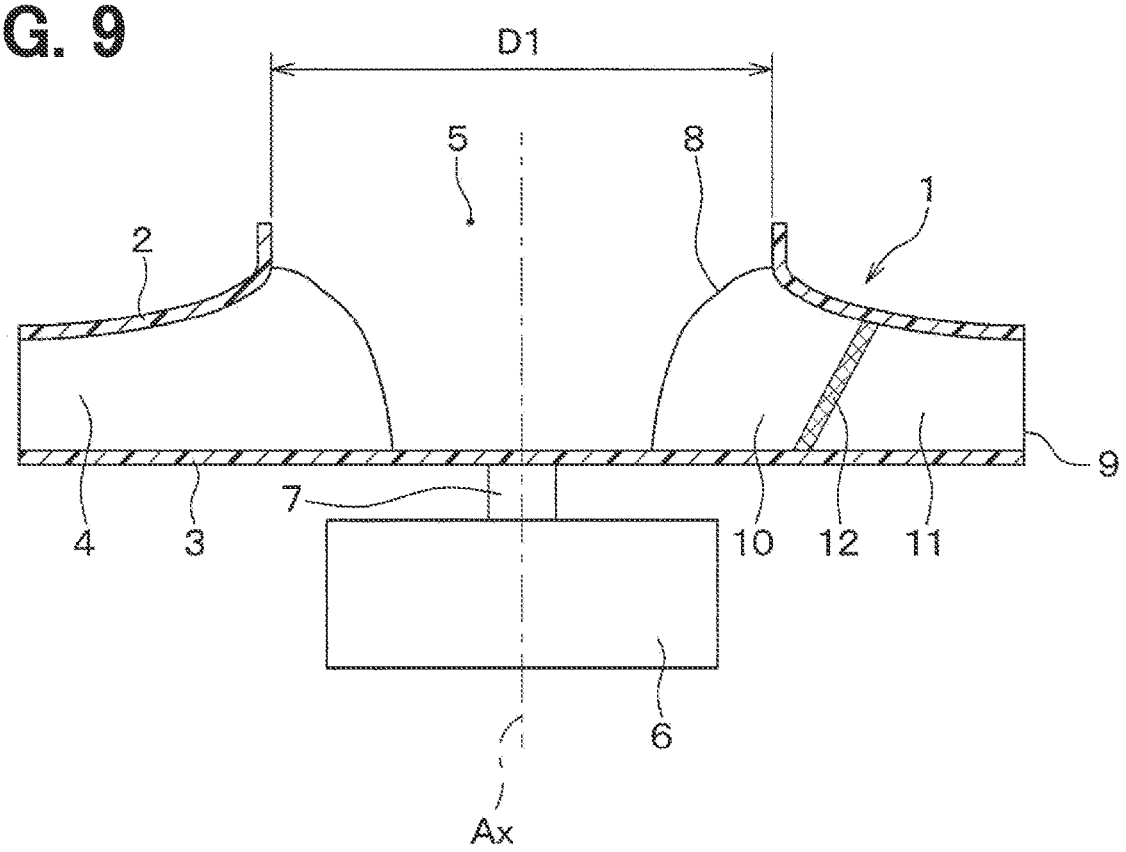
FIG. 9 is a cross-sectional view along a rotational axis of a turbofan according to a third embodiment.

Even in FIG. 9, a location, at which the stepped portion 12 is formed at the negative pressure surface of the blade 4, is indicated by the cross-hatching for the purpose of explanation. As shown in FIG. 9, in the third embodiment, the stepped portion 12 progressively extends toward the radially inner side in a direction that is directed from the shroud 2 toward the main plate 3. With this structure, in order to deal with the fast flow, which flows at the region adjacent to the main plate 3, this fast flow can be separated from the negative pressure surface of the blade 4 at a location, which is far from the trailing edge 9, and thereby the main flow can be further spaced away from the negative pressure surface of the trailing edge 9 of the blade 4 in the direction that is opposite to the rotational direction. Therefore, the flow velocity gradient of the flow, which collides against the negative pressure surface of the trailing edge 9 of the blade 4, can be reduced, and thereby the noise can be reduced.

Fourth Embodiment

The fourth embodiment will be described with reference to FIG. 10. The fourth embodiment is a modification of the structure of the stepped portion 12 in comparison to the first embodiment, and the rest of the fourth embodiment is the same as that of the first embodiment. Therefore, only the parts different from those of the first embodiment will be described in the following description.

Figure 10:
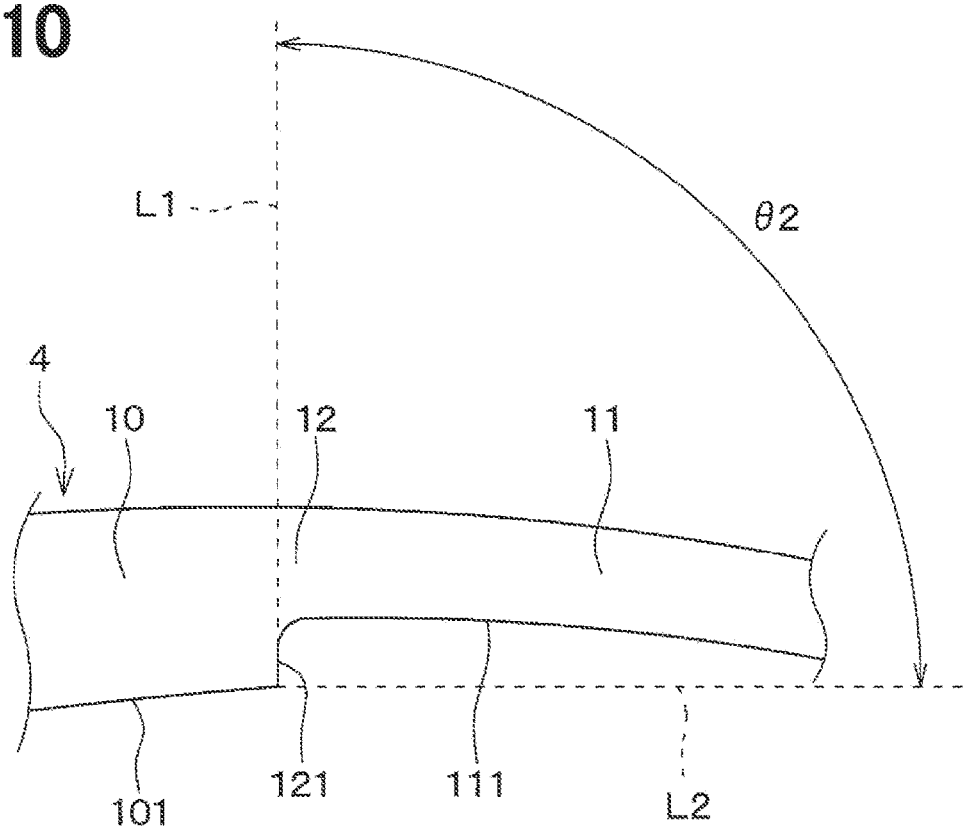
FIG. 10 is an enlarged view showing around a stepped portion of a blade of a turbofan of a fourth embodiment.

As shown in FIG. 10, according to the fourth embodiment, in the cross-section of the blade 4 that is perpendicular to the rotational axis Ax, the angle 82 between the first tangent line L1, which is tangent to the center part of the negative pressure surface 121 of the stepped portion 12, and the second tangent line L2, which is tangent to the adjacent part of the negative pressure surface of the thick wall portion 10 that is adjacent to the stepped portion 12, is about 90 degrees. Even with this structure, the boundary between the thick wall portion 10 and the stepped portion 12 serves as the start point, at which the velocity boundary layer generated in the flow along the negative pressure surface of the thick wall portion 10 begins to be disturbed, and this boundary functions as the separation point of the flow from the negative pressure surface of the blade 4 to generate the turbulent boundary layer therefrom. Thus, the main flow F3 can be spaced away from the negative pressure surface of the thin wall portion 11 in the direction that is opposite to the rotational direction. Therefore, even in the present embodiment, the position, at which the separation of the flow along the negative pressure surface of the blade 4 occurs, is shifted forward. Thus, the velocity gradient of the flow, which collides against the negative pressure surface of the trailing edge 9 of the blade 4, can be reduced to reduce the noise.

Other Embodiments (1) The turbofan 1 of the above respective embodiments is the closed fan, in which the main plate 3, the shroud 2 and the blades 4 are formed integrally in one-piece. The turbofan 1 may be an open fan, in which the main plate 3 and the plurality of blades 4 are formed integrally in one-piece, and the plurality of blades 4 and the shroud 2 are formed by separate members.

(2) In the first embodiment, there is described that the stepped portion 12 is formed only in the region between the boundary line C, which is close to the leading edge 8 at the time of dividing the blade length into the three equal parts, and the boundary line E, which divides the blade length into the two equal parts. However, the present disclosure is not limited to this. It is only required that the stepped portion 12 is formed in the region between the boundary line C, which is close to the leading edge 8 at the time of dividing the blade length into the three equal parts, and the boundary line D, which is close to the trailing edge 9 at the time of dividing the blade length into the three equal parts.

(3) In the first embodiment, there is described that, preferably, the plate thickness T1 of the thick wall portion 10 is set to be equal to or larger than 3 mm, and the radius of curvature of the segment of the leading edge 8, which is adjacent to the positive pressure surface of the blade 4, and the radius of curvature of the other segment of the leading edge 8, which is adjacent to the negative pressure surface of the thick wall portion 10, are respectively set to be equal to or larger than 1.5 mm. Alternatively, in the cross-section of the blade 4 that is perpendicular to the rotational axis Ax, the plate thickness T1 of the thick wall portion 10 and the radius of curvatures of the segments of the leading edge 8 may be arbitrary set.

The present disclosure is not limited to the above embodiments, and the above embodiments may be appropriately modified. Furthermore, the above embodiments are not unrelated to each other and can be appropriately combined unless the combination is clearly impossible. Needless to say, in each of the above-described embodiments, the elements of the embodiment are not necessarily essential except when it is clearly indicated that they are essential and when they are clearly considered to be essential in principle. In each of the above embodiments, when a numerical value such as the number, numerical value, amount, range or the like of the constituent elements of the embodiment is mentioned, the present disclosure should not be limited to such a numerical value unless it is clearly stated that it is essential and/or it is required in principle. In each of the above embodiments, when the shape, the positional relationship or the like of the constituent elements of the embodiment are mentioned, the present disclosure should not be limited the shape, the positional relationship or the like unless it is clearly stated that it is essential and/or it is required in principle.

CONCLUSION

According to a first aspect of the present disclosure, there is provided a turbofan that includes: a shroud which has a suction inlet that is configured to suction air; a main plate which is located on a side of the shroud in an axial direction of a rotational axis; and a plurality of blades which are located between the shroud and the main plate and are arranged one after another around the rotational axis. Each of the plurality of blades has a thick wall portion, a thin wall portion and a stepped portion. The thick wall portion has a plate thickness that is relatively large, and the thick wall portion is located adjacent to a leading edge of the blade. The thin wall portion has a plate thickness that is smaller than the plate thickness of the thick wall portion, and the thin wall portion is located on a side of the thick wall portion where a trailing edge of the blade is placed. The stepped portion is formed between the thick wall portion and the thin wall portion, and a plate thickness of the stepped portion is progressively decreased toward a positive pressure surface of the blade in a direction that is directed from the thick wall portion toward the thin wall portion. In a cross-section of each of the plurality of blades that is perpendicular to the rotational axis, a first curved surface forms a negative pressure surface of the thick wall portion and is arcuate, and a second curved surface forms a negative pressure surface of the thin wall portion and is arcuate while the second curved surface is located on a side of the first curved surface where the positive pressure surface of the blade is placed, and a negative pressure surface of the stepped portion connects between the first curved surface and the second curved surface.

According to a second aspect, when a blade length of each of the plurality of blades is equally divided into three parts, the stepped portion is located at a center part that is centered among the three parts.

According to this, since the stepped portion is not formed in the most upstream part among the three parts, it is possible to improve the robustness to the inflow angle of the flow. Furthermore, the flow along the negative pressure surface of the thick wall portion is disturbed at the stepped portion, which is formed at the center part, and this boundary functions as the separation point of the flow to generate a turbulent boundary layer therefrom. Thus, the main flow can be spaced away from the negative pressure surface of the thin wall portion in the direction that is opposite to the rotational direction. Therefore, the flow velocity gradient of the flow, which collides against the negative pressure surface of the trailing edge of the blade, can be reduced, and thereby the noise can be reduced.

According to a third aspect, the leading edge of each of the plurality of blades is located on a radially inner side of an inner diameter of the suction inlet of the shroud. The stepped portion is located on a radially outer side of the inner diameter of the suction inlet of the shroud.

Since the stepped portion is not placed on the radially inner side of the inner diameter of the suction inlet of the shroud, the flow, which enters from the inlet at the blade, can flow along the wall surface of the thick wall portion from the leading edge of the blade in the inter-blade flow passage. Therefore, it is possible to improve the robustness to the inflow angle of the flow.

According to a fourth aspect, a negative pressure surface of a boundary between the stepped portion and the thick wall portion is shaped in a form of a smooth curved surface.

Since the corner is not formed along the negative pressure surface at the boundary between the stepped portion and the thick wall portion, even when the vortex is generated at the boundary (i.e., the separation point of the flow) between the thick wall portion and the stepped portion, the noise generated at this boundary can be reduced.

According to a fifth aspect, the plate thickness of the thin wall portion is equal to or smaller than 75% of the plate thickness of the thick wall portion.

According to the experiment conducted by the inventors of the present application, it is found that the low-noise effect becomes extremely large when the plate thickness of the thin wall portion is equal to or smaller than 75% of the plate thickness of the thick wall portion. According to the experiment, the noise can be reduced by 1.5 dB or more.

According to a sixth aspect, in the cross-section of each of the plurality of blades that is perpendicular to the rotational axis, the negative pressure surface of the stepped portion is shaped in a form of a curved surface that is convex toward the positive pressure surface of the blade.

According to this structure, it is possible to increase the distance between the negative pressure surface of the stepped portion and the vortex, which is generated at the boundary (i.e., the separation point of the flow) between the thick wall portion and the stepped portion, and thereby the noise generated at this boundary can be reduced.

According to a seventh aspect, in the cross-section of each of the plurality of blades that is perpendicular to the rotational axis, an angle between a tangent line, which is tangent to a center part of the negative pressure surface of the stepped portion, and a tangent line, which is tangent to an adjacent part of the negative pressure surface of the thick wall portion that is adjacent to the stepped portion, is an acute angle.

Since the corner is not formed along the negative pressure surface at the boundary between the stepped portion and the thick wall portion, even when the vortex is generated at the boundary (i.e., the separation point of the flow) between the thick wall portion and the stepped portion, the noise generated at this boundary can be reduced.

According to an eighth aspect, in the cross-section of each of the plurality of blades that is perpendicular to the rotational axis, a radius of curvature of a segment of the leading edge, which is adjacent to the positive pressure surface of the blade, and a radius of curvature of another segment of the leading edge, which is adjacent to the negative pressure surface of the thick wall portion, are respectively set to be equal to or larger than 1.5 mm, and a plate thickness of the leading edge of each of the plurality of blades is set to be equal to or larger than 3 mm.

With this structure, by increasing the plate thickness of the leading edge, the flow, which enters from the inlet at the blade, can flow along the wall surface of the thick wall portion from the leading edge of the blade in the inter-blade flow passage. Therefore, it is possible to improve the robustness to the inflow angle of the flow.

According to a ninth aspect, in each of the plurality of blades, the stepped portion is formed at least in a height range of the trailing edge of the blade.

With this structure, the main flow can be spaced away from the negative pressure surface of the trailing edge of the blade in the direction that is opposite to the rotational direction in the height range of the trailing edge of the blade, and thereby the noise, which is generated at the trailing edge of the blade, can be reduced.

According to a tenth aspect, the stepped portion progressively extends toward a radially inner side in a direction that is directed from the shroud toward the main plate.

With this structure, in order to deal with the fast flow, which flows at the main plate side, this fast flow can be separated at the location, which is far from the trailing edge, and thereby the main flow can be further spaced away from the negative pressure surface of the trailing edge of the blade in the direction that is opposite to the rotational direction. Therefore, the flow velocity gradient of the flow, which collides against the negative pressure surface of the trailing edge of the blade, can be reduced, and thereby the noise can be reduced.

What is claimed is:

1. A turbofan comprising:

a shroud which has a suction inlet that is configured to suction air;

a main plate which is located on a side of the shroud in an axial direction of a rotational axis; and a plurality of blades which are located between the shroud and the main plate and are arranged one after another around the rotational axis, wherein:

each of the plurality of blades is convexly curved in a rotational direction and has:

a thick wall portion which has a plate thickness that is larger than a predetermined thickness, wherein the thick wall portion is located adjacent to a leading edge of the blade;

a thin wall portion which has a plate thickness that is smaller than the predetermined thickness and the plate thickness of the thick wall portion, wherein the thin wall portion is located on a side of the thick wall portion where a trailing edge of the blade is placed; and a stepped portion which is formed at a negative pressure surface of each of the plurality of blades at a location between the thick wall portion and the thin wall portion, wherein a plate thickness of the stepped portion is progressively decreased toward a positive pressure surface of the blade in a direction that is directed from the thick wall portion toward the thin wall portion;

in a cross-section of each of the plurality of blades that is perpendicular to the rotational axis, a first curved surface forms a negative pressure surface of the thick wall portion and is arcuate, and a second curved surface forms a negative pressure surface of the thin wall portion and is arcuate while the second curved surface is located on a side of the first curved surface where the positive pressure surface of the blade is placed, and a negative pressure surface of the stepped portion connects between the first curved surface and the second curved surface;

the leading edge of each of the plurality of blades is located on a radially inner side of an inner diameter of the suction inlet of the shroud;

the stepped portion generates a turbulent boundary layer of the air on a downstream side of the stepped portion and thereby deflects a main flow of the air away from the negative pressure surface of the thin wall portion when the air flows along the negative pressure surface of each of the plurality of blades; and the stepped portion is formed only in a region between:

a radially innermost one of two boundary lines which is closest to the leading edge when a blade length of each of the plurality of blades is equally divided into three parts by the two boundary lines; and a center boundary line, which divides the blade length into two equal parts.

2. The turbofan according to claim 1, wherein the stepped portion is located on a radially outer side of the inner diameter of the suction inlet of the shroud.

3. The turbofan according to claim 1, wherein a negative pressure surface of a boundary between the stepped portion and the thick wall portion is shaped in a form of a smooth curved surface.

4. The turbofan according to claim 1, wherein the plate thickness of the thin wall portion is equal to or smaller than 75% of the plate thickness of the thick wall portion.

5. The turbofan according to claim 1, wherein in the cross-section of each of the plurality of blades that is perpendicular to the rotational axis, the negative pressure surface of the stepped portion is shaped in a form of a curved surface that is convex toward the positive pressure surface of the blade.

6. The turbofan according to claim 1, wherein in the cross-section of each of the plurality of blades that is perpendicular to the rotational axis, an angle between a tangent line, which is tangent to a center part of the negative pressure surface of the stepped portion, and a tangent line, which is tangent to an adjacent part of the negative pressure surface of the thick wall portion that is adjacent to the stepped portion, is an acute angle.

7. The turbofan according to claim 1, wherein in the cross-section of each of the plurality of blades that is perpendicular to the rotational axis, a radius of curvature of a segment of the leading edge, which is adjacent to the positive pressure surface of the blade, and a radius of curvature of another segment of the leading edge, which is adjacent to the negative pressure surface of the thick wall portion, are respectively set to be equal to or larger than 1.5 mm, and a plate thickness of the leading edge of each of the plurality of blades is set to be equal to or larger than 3 mm.

8. The turbofan according to claim 1, wherein in each of the plurality of blades, the stepped portion is formed at least in a height range of the trailing edge of the blade.

9. The turbofan according to claim 1, wherein the stepped portion progressively extends toward a radially inner side in a direction that is directed from the shroud toward the main plate.

* * * * *